United States Patent [19]

Brodsky et al.

[11] 4,392,372

[45] Jul. 12, 1983

[54] METHOD AND APPARATUS FOR FLANGING TUBE ENDS

[75] Inventors: Alexander Brodsky; Richard J. Clark, both of Auckland, New Zealand

[73] Assignee: Fisher & Paykel Limited, Auckland, New Zealand

[21] Appl. No.: 236,272

[22] Filed: Feb. 20, 1981

[30] Foreign Application Priority Data

Mar. 3, 1980 [NZ] New Zealand ..... 193022

[51] Int. Cl.[3] ..... B21D 7/04; B21D 51/18

[52] U.S. Cl. ..... 72/311; 72/370; 72/385; 72/402; 72/452

[58] Field of Search ..... 72/370, 385, 311, 383, 72/399, 402, 452

[56] References Cited

U.S. PATENT DOCUMENTS

| | | | |
|---|---|---|---|
| 1,425,549 | 8/1922 | Scruby . | |
| 1,840,317 | 1/1932 | Horvath | 29/157.3 AH |
| 1,909,649 | 5/1973 | Bayless . | |
| 2,565,188 | 8/1951 | Welshenbach | 229/16 |
| 2,674,400 | 4/1954 | Ross | 229/37 |
| 2,844,296 | 7/1958 | Soja | 229/39 |
| 3,174,675 | 3/1965 | Rosenburg, Jr. | 229/41 |
| 3,302,853 | 2/1967 | Locke | 229/39 |
| 3,526,352 | 9/1970 | Swett | 229/39 |
| 3,736,787 | 6/1973 | Fencl et al. | 72/385 |
| 3,873,017 | 3/1975 | Blatt | 229/41 |
| 3,907,194 | 9/1975 | Davenport | 229/23 |
| 4,101,022 | 7/1978 | Watkins | 206/45 |
| 4,114,795 | 9/1978 | Mulroy | 229/23 |
| 4,119,266 | 10/1978 | Dempster | 229/39 |
| 4,178,790 | 12/1979 | Buckley et al. | 72/402 |
| 4,225,078 | 9/1978 | Croley | 229/41 |
| 4,309,891 | 1/1982 | Rogonowski | 72/370 |

FOREIGN PATENT DOCUMENTS

| | | | |
|---|---|---|---|
| 88179 | 12/1936 | Sweden | 72/385 |

*Primary Examiner*—Daniel C. Crane
*Attorney, Agent, or Firm*—Holman & Stern

[57] ABSTRACT

A method and machine for flanging tube ends, the machine having pivotal inner (22) and outer (30) forming tools which flange one end of a thin metal tube (21) specifically to form a rotatable drum for laundry machines. The tools are actuated by hydraulic rams (A), (B) and (C) and the rams are actuated at different rates of movement under the control of a computer so that as forming is effected by moving both sets of tools from dispositions on a cylinder to dispositions on a disc the inner forming tools (22) have their pivot points 24 changed relative to pivot points (31) of the outer forming tools (30) resulting in relative sliding between inner and outer forming tools. The flange (51) formed has two sets of ribs, one set extending outwardly away from the tube (21) and the other set extending inwardly within the tube (21) and parts of the flange between adjacent ribs lying in a plane substantially at right angles to the wall of the tube (21).

11 Claims, 14 Drawing Figures

METHOD AND APPARATUS FOR FLANGING TUBE ENDS

FIELD OF THE INVENTION

This invention relates to methods of and or apparatus for flanging tube ends particularly though not solely for flanging the ends of tubes to form rotatable drums for laundry machines.

BRIEF SUMMARY OF THE INVENTION

It is an object of the present invention to provide a method of and or apparatus for flanging tube ends.

In one aspect the invention consists in a method of flanging one end of a thin metal tube comprising the steps of mounting a sheet metal tube on a carriage, fixing the tube to the carriage, placing complementary pivotal inner and outer forming tools with parts thereof in contact with one end portion of said tube, the inner forming tools being pivotal on an inner frame and the outer forming tools being pivotal on an outer carriage and moving the inner and outer forming tools with the metal between them in a manner such that the metal is castellated to form a radially inwardly directed flange on one end of said tube, said flange having a cross section or shape which includes two sets of oppositely directed ribs the sides of which increase in depth from the tube wall towards the tube center, the method including the step of sliding said inner and outer forming tools relative to each other during the formation of said flange.

In a further aspect the invention provides apparatus for use in flanging one end of a thin metal tube comprising a frame, an outer carriage slidable on members forming part of said frame, a plurality of radially arranged pivotal outer forming tools pivotally mounted on said outer carriage so as to be pivotal through substantially 90°, an intermediate carriage slidable on said frame members, means on said intermediate carriage enabling a tube to be formed to be clamped thereon, a plurality of radially arranged pivotal inner forming means pivotally mounted on said intermediate carriage and arranged to be pivoted through substantially 90°, means to cause said outer forming means to pivot through said substantially 90° and force supplying means arranged to move said inner and outer forming means in a manner such that a radially inwardly directed flange on one end of said tube is formed, said flange having a width less than the radius of the tube, said flange having a cross sectional shape of a series of two sets of oppositely directed ribs the sides of which increase in depth from the tube wall towards the tube centre, said inner and outer forming means sliding relative to each other during formation of the flange.

To those skilled in the art to which this invention relates, many changes in construction and widely differing embodiments and applications of the invention will suggest themselves without departing from the scope of the invention as defined in the appended claims. The disclosures and the descriptions herein are purely illustrative and are not intended to be in any sense limiting.

The invention consists in the foregoing and also envisages constructions of which the following gives examples only.

BRIEF DESCRIPTION OF THE SEVERAL VIEWS OF THE DRAWING

One preferred form of the invention and modifications thereof will now be described with reference to the accompanying drawings in which.

DETAILED DESCRIPTION

Figure 1:
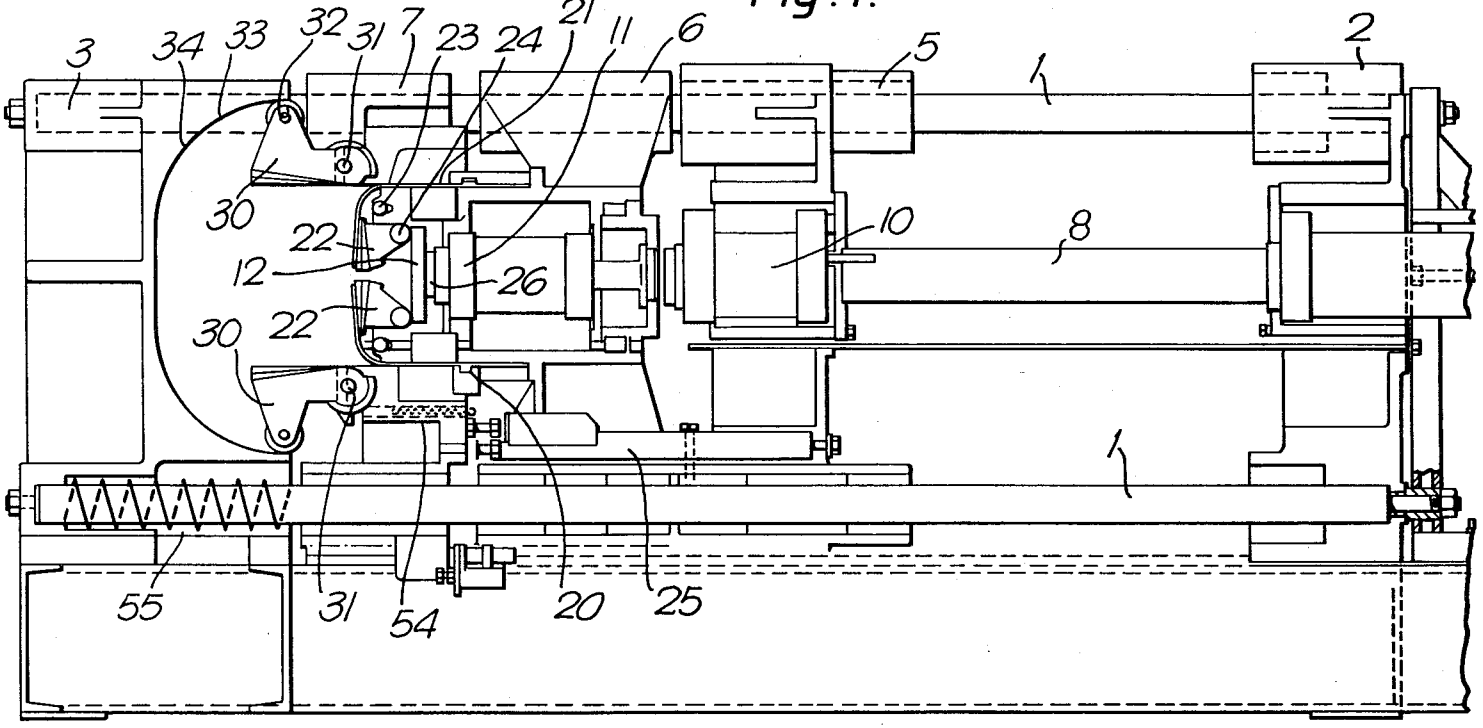
FIG. 1 is a diagrammatic elevational view of apparatus according to the iinvention.

Referring to the drawings apparatus according to the invention comprises a frame of which the rods 1 form part, there being body members 2 and 3 at either end of the frame which support the rods. There are four rods 1, the general formation of the body parts 2 and 3 being square in a plane at right angles to the plane of FIG. 1. Slidably mounted on the rods 1 are three carriages, a main carriage 5 and intermediate carriage 6 and an outer carriage 7. The main carriage 5 is actuated by a piston rod 8 of a piston and cylinder assembly (C) only part of which is shown in the drawings. The intermediate carriage 6 is actuable relative to the main carriage 5 by a piston and cylinder assembly (B) and the intermediate carriage 6 carries a further piston and cylinder assembly (A) which actuates a cam plate 12. The outer carriage 7 is actuated through push rods 25 from the main carriage 5.

The intermediate carriage 6 carries a clamping means 20 whereby a sheet metal workpiece, for example, stainless steel tube or hollow cylinder 21 is clamped in position on the intermediate carriage 6. The intermediate carriage 6 also has pivotally mounted on it a plurality e.g. six to twenty-four, preferably sixteen inner forming tools 22 arranged symmetrically around a circle. The outer carriage 7 carries a corresponding plurality of pivotal outer forming tools 30 pivoted at 31 and the outer forming tools 30 are caused to move from the position shown in FIG. 1 to a position at right angles thereto by a roller 32 engaging a cam surface 33 on a body member 34, the cam surface 33 being in the shape of a depression. Thus movement of the outer carriage 7 relative to the body member 34 causes movement of the outer forming members 30. Movement of the inner forming members 22 is controlled by rollers 24 engaging on the cam plate 12 so that extension of the piston rod 26 causes movement of the inner forming tools 22 through substantially 90° to lie adjacent to the forming tools 30 in the position in which the outer forming tools lie as shown in FIG. 1.

Figure 2:
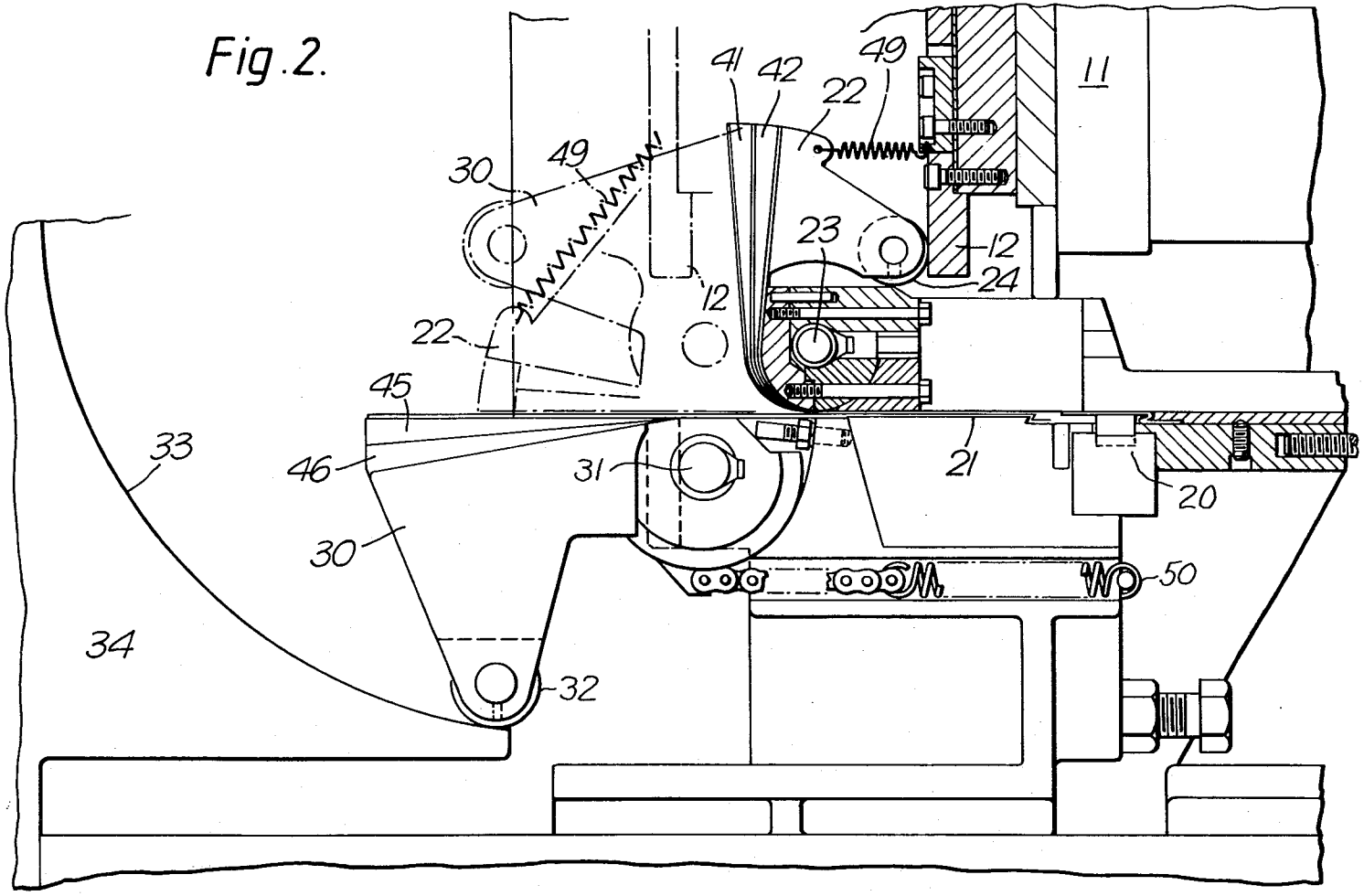
FIG. 2 is an enlarged elevational view, partly in cross-section, of the forward part of FIG. 1.
Figure 3:
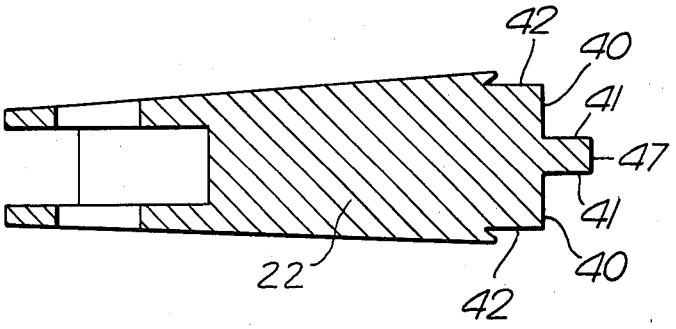
FIG. 3 is a view in cross section of an inner forming tool used in the invention of FIG. 1.
Figure 4:
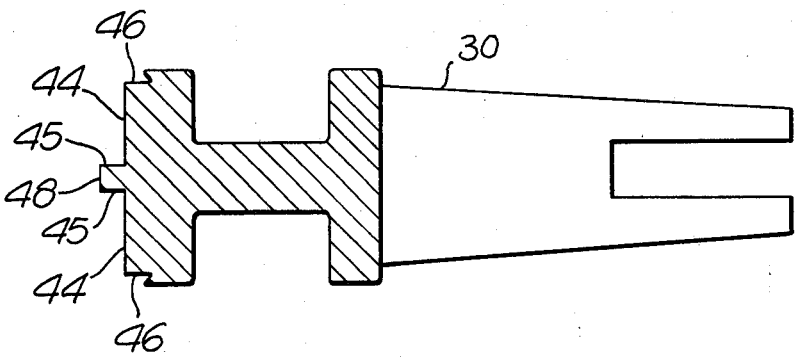
FIG. 4 is a view in cross section of an outer forming tool.
Figure 6:
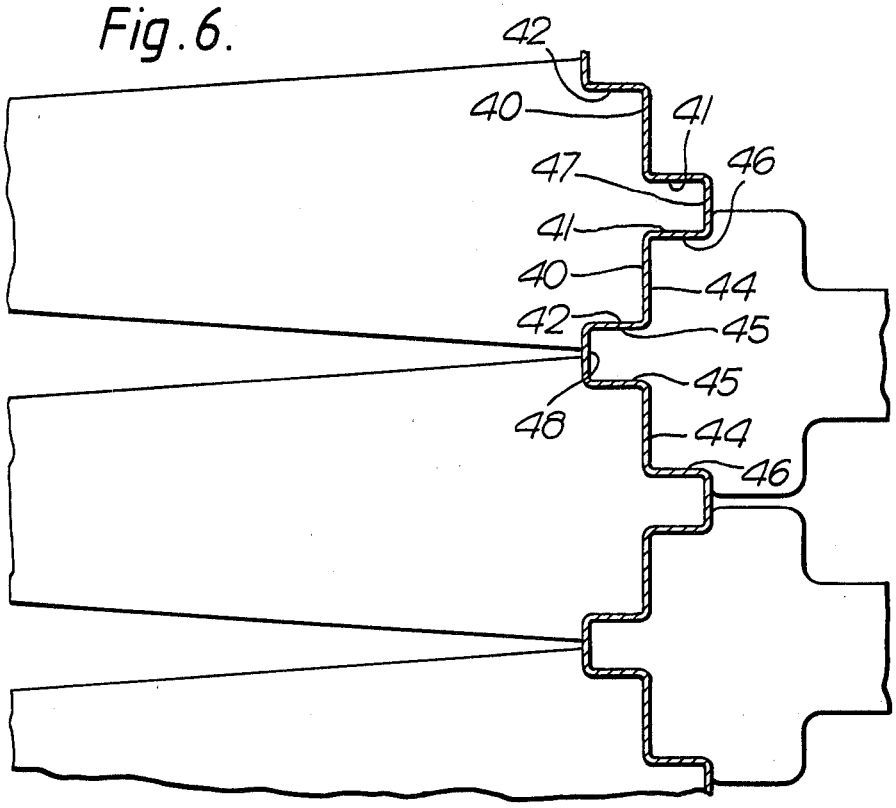
FIG. 6 is a cross sectional view taken on the line A—A of FIG. 5.

The inner and outer forming tools are shown individually in cross section in FIGS. 3 and 4 respectively and parts are shown diagrammatically in FIG. 6 with a section of the corrugations at a particular radius. The surfaces which actually form a castellated or corrugated flange on the tube 21 comprise the surfaces 40, 41 and 42 in FIG. 3 and corresponding surfaces 44, 45 and 46 in FIG. 6. The inner and outer forming tools are not arranged opposite each other but are staggered as shown in FIG. 6 so that e.g. left hand side surfaces of an inner tool are adjacent right hand side surfaces of an outer tool and so on. As may be seen in FIG. 2 the surfaces 41 and 42 and 45 and 46 are of substantially triangular formation. However because the inner and outer forming tools slide relative to each other in the direction of their length some surfaces are arranged so that such sliding can take place along substantially radial lines as will be described further shortly.

Springs 49 and 50 are provided to return the forming tools to starting positions and springs 55 return the outer carriage 7 to its starting position.

Figure 8:
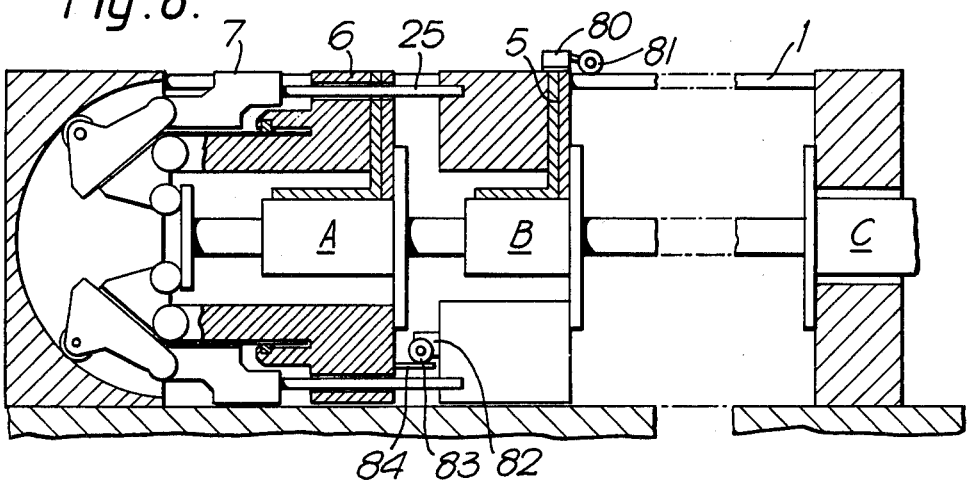
FIG. 8 is a simplified cross-sectional view of parts of the machine of FIG. 1.
Figure 7:
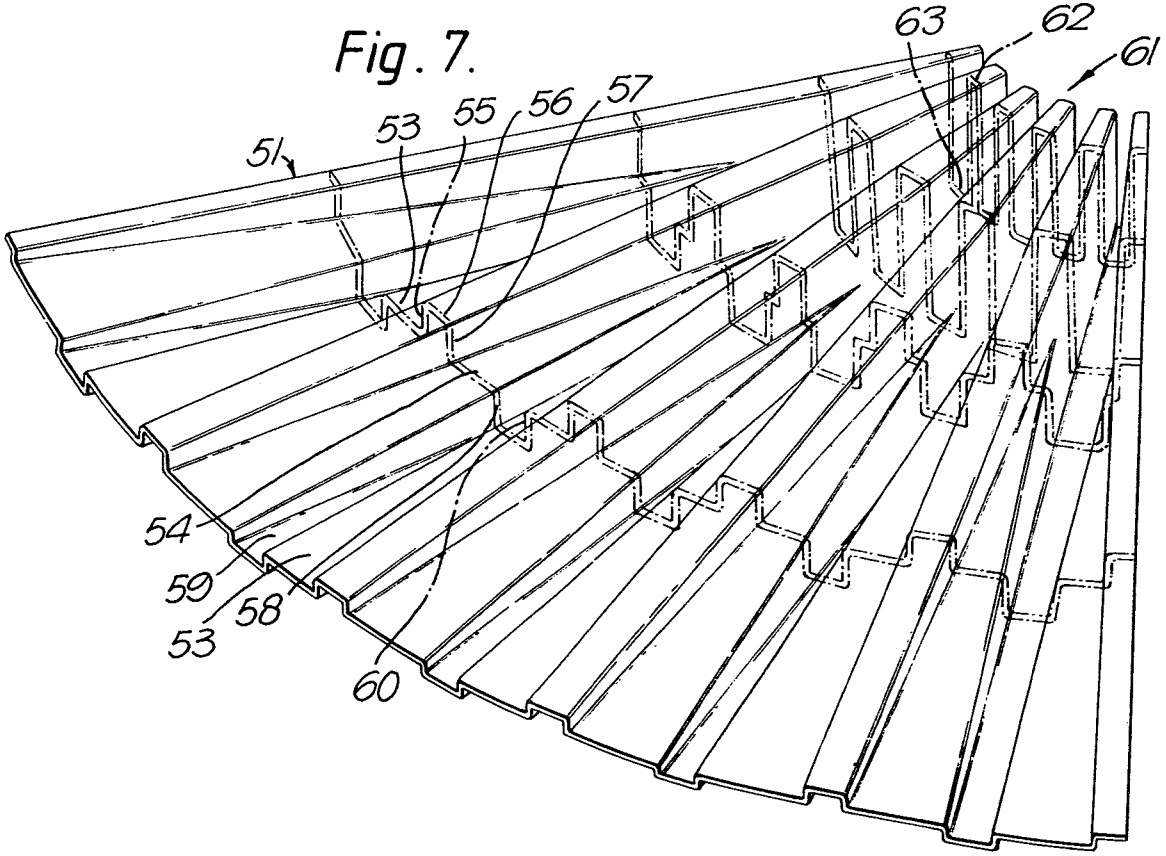
FIG. 7 is a perspective view of a part of the drum flange with cross sections superimposed thereon.
Figure 9:
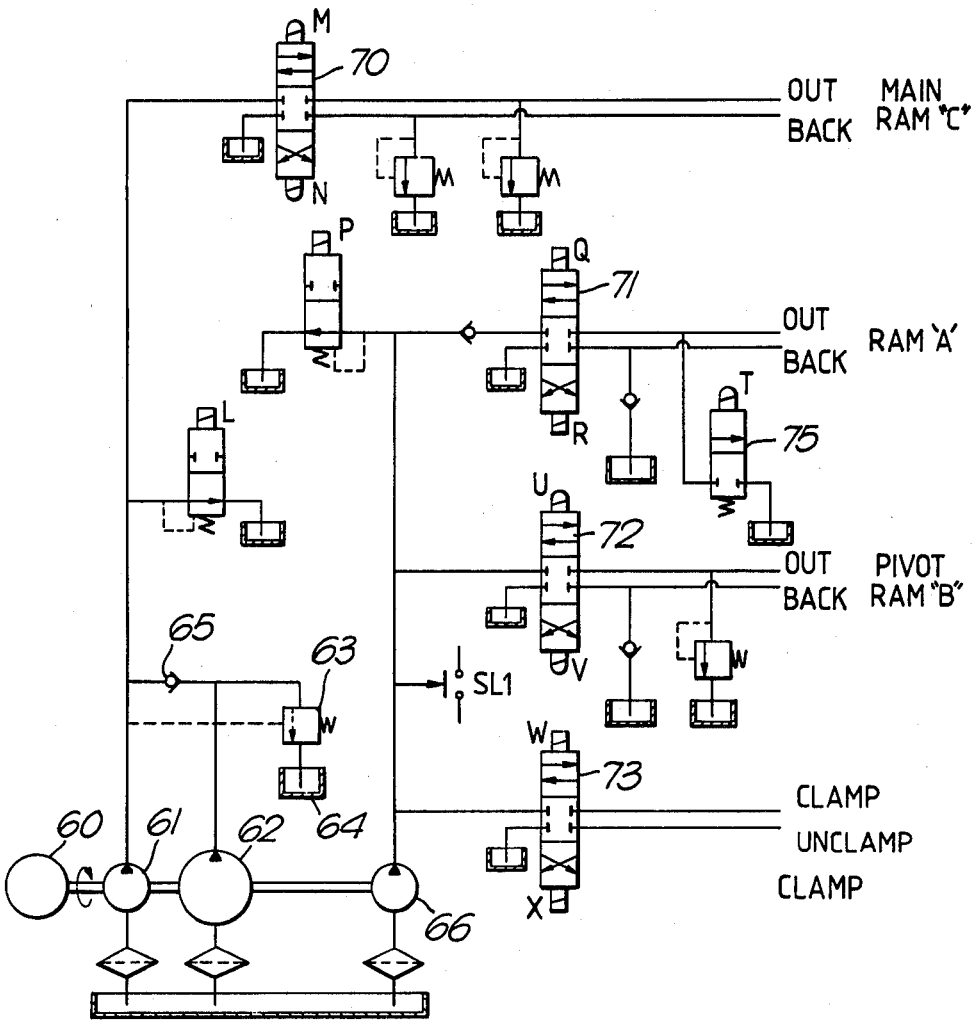
FIG. 9 is a diagram of a hydraulic circuit for the machine of FIG. 1, and FIGS. 10 to 14 are flow diagrams of computer or micro-processor control systems for the machine of the invention.
Figure 10:
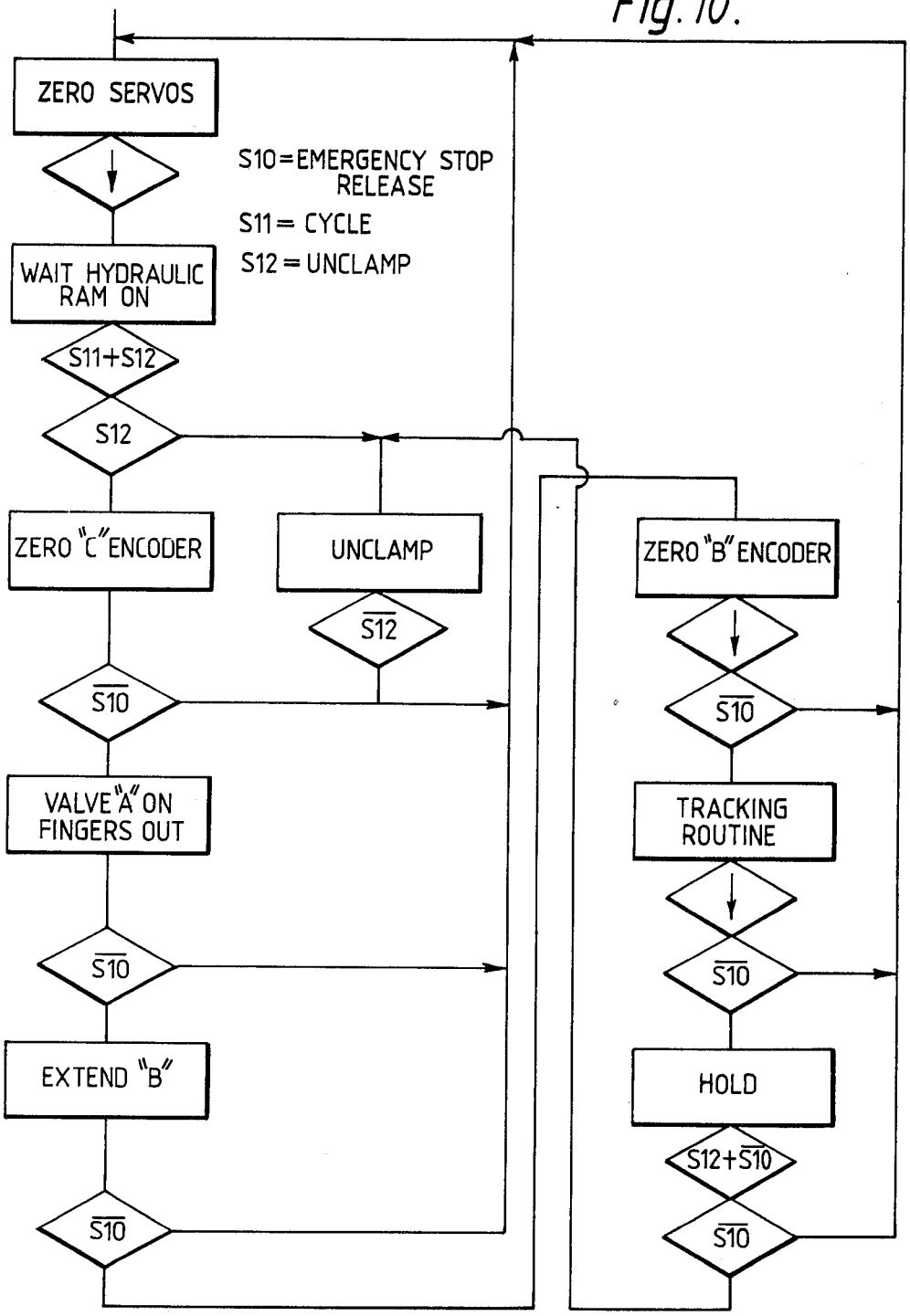

The actuation of the machine is effected by hydraulic power and the circuit is shown in FIG. 9. Referring to this figure and to the simplified FIG. 8 a motor 60 drives two pumps 61 and 62, the output of these pumps being connected to a dump valve 63 and tank 64, the pump 61 being connected through a non-return valve 65. The purpose of this arrangement is so that considerable volumes of oil can be provided when required but when not required and the pressure is increasing the dump valve 63 opens to permit discharge into the tank 64 through the dump valve 63 thus avoiding over-run and keeping the power demand within the limit of the motor 60. These pumps are connected to supply the main ram (C) in FIG. 8 and the outer forming tool ram (A) and the ram (B) which controls the point of pivoting of the inner forming tools are supplied by a further pump 66 also driven by motor 60.

The main ram (C) is supplied through a servo valve 70 which is a flow control valve to give controlled acceleration. The ram (A) is controlled through a non-proportional solenoid valve 71 such as a NACH1 type SA-G03-C5X, and ram (B) through a proportional servo valve 72 such as M00G AO76-104 controllable as to flow. An additional non-proportional solenoid valve 73 actuates the clamp 20 to clamp the tube onto the actuating carriage. The valve is a proportional pressure relief control which controls the back up force on the inner forming tools 22. The remaining hydraulic circuitry is arranged to provide relief valves operating under suitable pressures.

Control of the hydraulic circuit as shown in FIG. 9 is effected by a computer or micro-processor, for example an RCA model 1802 Micro-processor. The flow diagrams are shown in FIGS. 10 to 14. Mounted on the main carriage 5 is an encoder 80, for example, an Accu-Coder model 716 encoder which gives two series of signals of square wave pulse shape, the two sets of signals having a 90° phase relationship, thus giving 4000 transitions per revolution and giving both distance and direction of movement when the wheel 81 is rotated by movement of the carriage 5 relative to a rod 1. An additional encoder 82 is mounted on the carriage 5 and has a wheel 83 running on a rod 84, the rod 84 being fixed to the intermediate carriage 6. The ratio of wheel diameters of encoders 80 and 82 is such that they have a 2:1 distance ratio. Thus for example the wheel 81 has a circumference of 400 mm and the wheel 83 a circumference of 200 mm. According to the flow chart the necessary program which is shown in detail in Table 1 hereto, which is in assembler language, operates the machine so that when commencing a cycle of operations the servos 70 and 72 are zeroed and the machine instructed to wait but with the hydraulic pumps switched on. In the event that a signal S11 has been given to commence a cycle, if the encoder 80 is zeroed the solenoid valve 71 is actuated to extend the inner forming tools 22 to the position alongside the outer forming tools as shown in FIG. 1. At frequent intervals in the flow chart an emergency stop S10 is provided which provided it is released, i.e. not actuated, permits the next step in the flow chart to be operated. When the inner tools 22 have been extended, a signal is given to extend the intermediate carriage (B) that is to say servo valve 72 is opened to cause that extension. The (B) encoder which is encoder 82 is then zeroed and following this the tracking routine followed through and following the tracking routine the machine is instructed to hold and extends back up to the wait indication.

Figure 11:
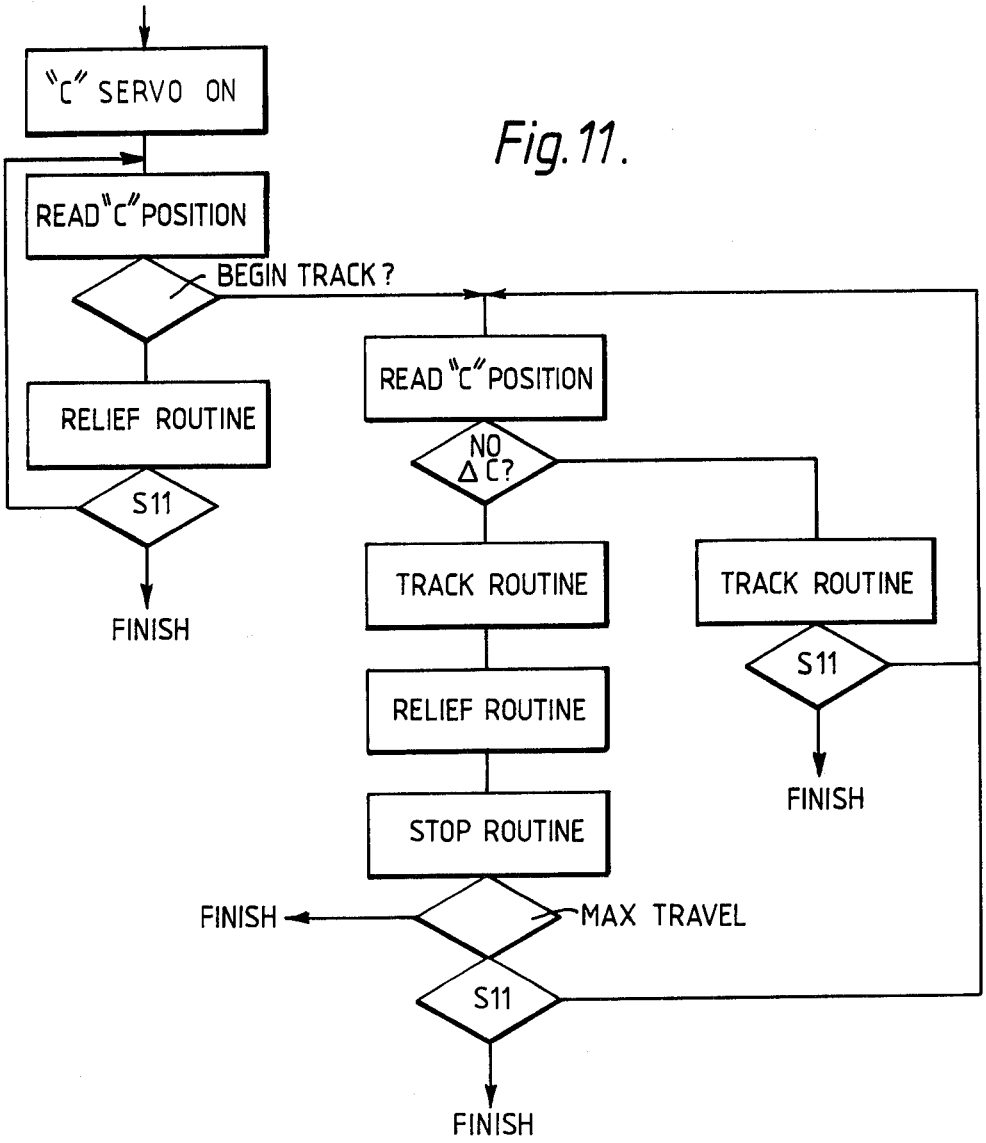
Figure 12:
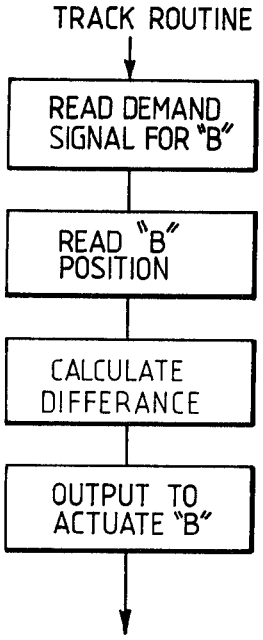
Figure 13:
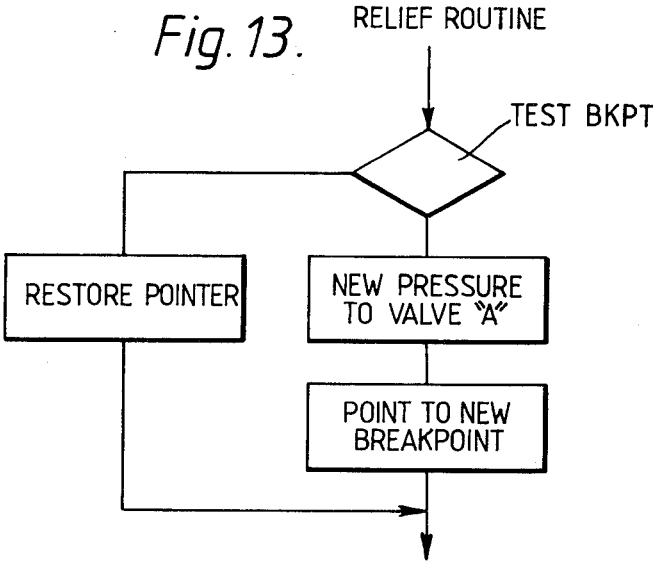

The tracking routine is shown in FIG. 11 where a signal is provided to energize the (C) servo 70. The (C) ram position, i.e. the amount of extension of the main ram, is established by reading the encoder 80 and if tracking is to be effected the (C) position is read again and is in fact read at frequent intervals. If there is no change in the (C) position the instruction is given to follow the track routine shown in FIG. 12. In this figure a demand signal indicating the desired position of ram (B) is stored in the micro-computer and this demand position is established. The position of ram (B) is then read by encoder 80 and the difference between the reading of encoder 80 and the demand signal calculated within the micro-computer. (B) servo 72 is then energized to actuate the (B) ram to reduce the difference to zero. This checking of the position of the (B) ram extension and thus the point of the intermediate carriage 6 against its calculated position is effected continuously until the demand reading indicates that the process of forming the flange on the drum is completed when the stop routine signal is indicated at max-travel indicating finish of that particular run. In the event that a relief routine is required to be shown, this relief routine is shown in FIG. 13 which indicates that a pressure in the (A) piston and cylinder assembly corresponding to a particular break point, i.e. a desired pressure, has been reached and a new pressure is applied to the pressure valve 75 and a new break point is established, i.e. a new pressure provided to which ram (A) may build up and the program pointer is restored to enable a further break point to be set up in turn when the newly set up track point is realized.

This arrangement is provided so that the working pressure between the outer forming tools 30 and the inner forming tools 22 is adjusted and the inner forming tools "give way" as the pressure break points are reduced during the operation. We have found that eight break points give a satisfactory control so that over pressures in the hydraulic circuits do not occur and so that satisfactory forming of the flange is effected.

Figure 14:
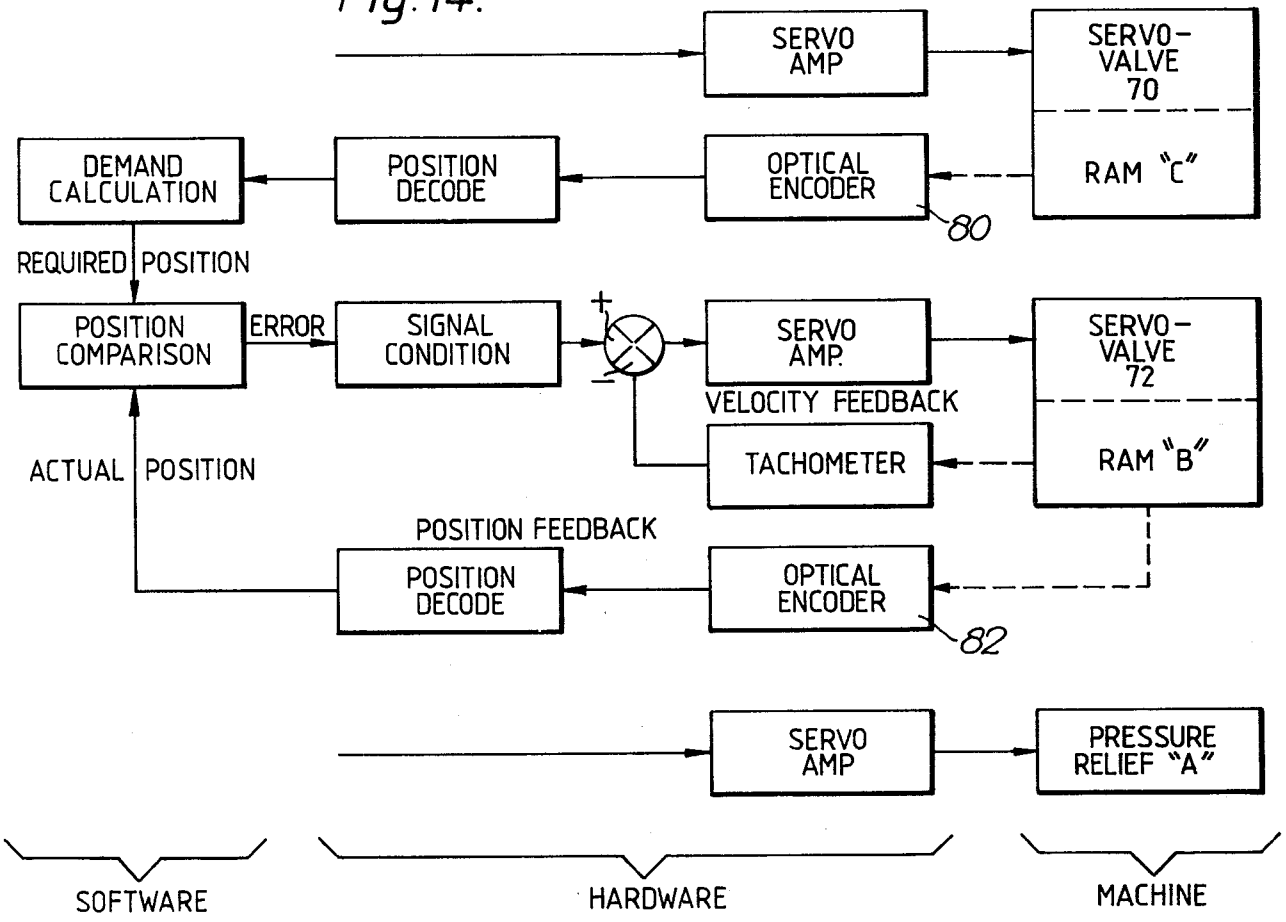

Referring to FIG. 14 the operation in relation to the track routine is illustrated. The servo amplifier energizes the servo valve 70 to move ram (C). The encoder 80 indicates the amount of movement, the indication is decoded and the demand signal calculated which indicates the required position to a position comparison device which calculates the error or difference. A signal is then supplied to a signal condition indicator which gives a positive or negative signal to the servo amplifier and thus the servo valve 72 actuating ram (B). The tachometer feeds back into the position indicator and the encoder 82 feeds back a position decode which in turn is fed back to the position comparison device with the demand calculation or required position indicator. In addition the ram (A) has a pressure relief valve 75 which is electrically actuated to give the required pressure relief. The divisions between software, hardware and machine actuated devices are shown in the diagram.

The operation of the apparatus is as follows:

The particular construction devised has been so devised for use in forming a rotatable drum for laundry machines. The drum comprising a cylindrical member formed from a sheet material, the cylinder having one open end and the apparatus forming a radially inwardly direct flange on the opposite end thereof, the flange having a cross sectional shape of a series of ribs, one set of ribs projecting upwardly or away from the interior of the drums, and the other set of ribs projecting into the interior of drum so formed, ribs of one set alternating with ribs of the other set, the outer faces of the ribs in each set lying on a frustum of a cone and parts of the flange between the ribs lying on a plane substantially at right angles to the wall of the tube.

Figure 5:
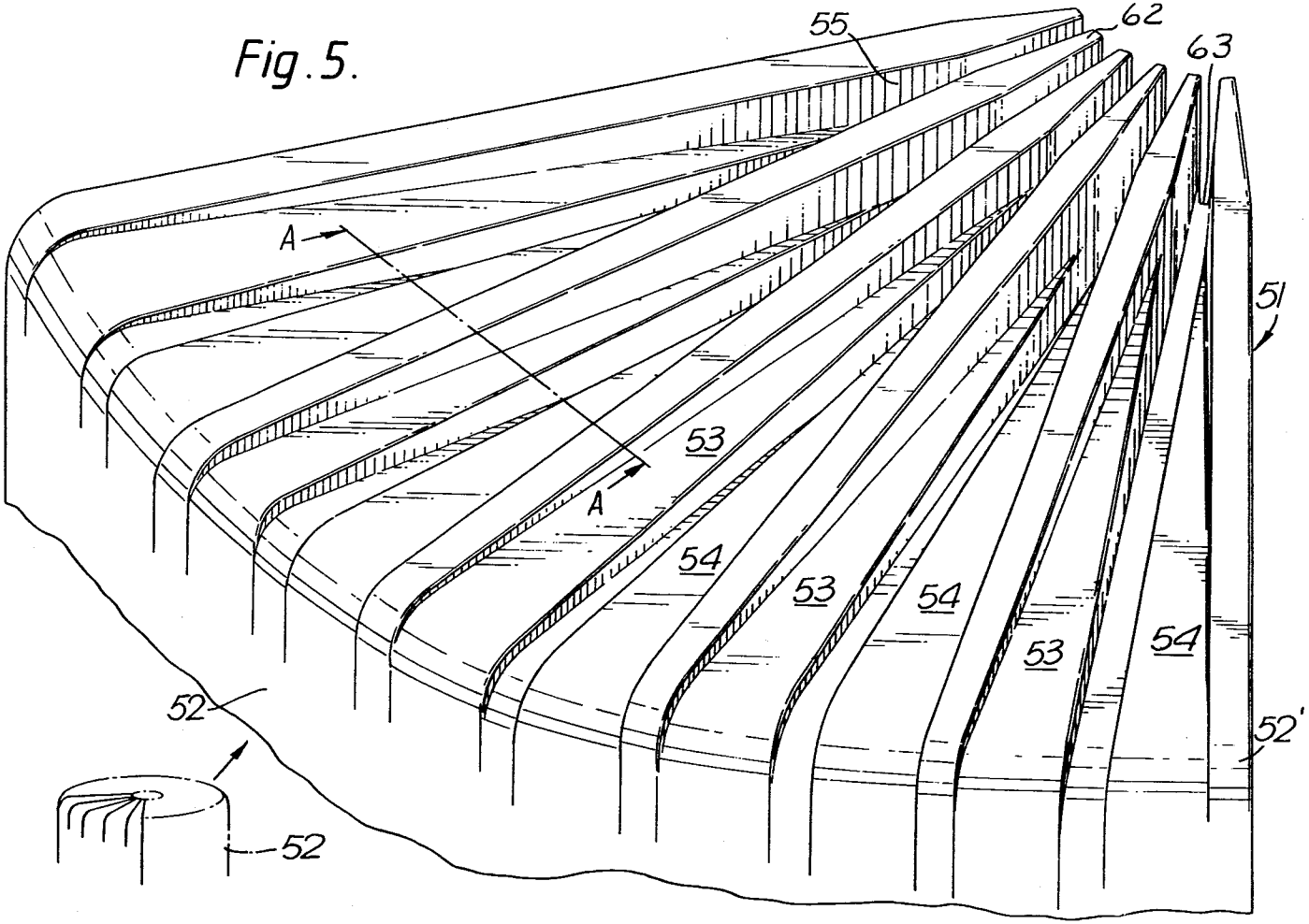
FIG. 5 is a perspective view of a flanged cylinder made by the apparatus according to the invention.

Accordingly a cylinder of sheet material e.g. stainless steel is prepared for example, by welding up a sheet of material which has been warped or otherwise formed to a tube of circular cross section. The sheet of material is placed and clamped by clamping means 20 in position as a tube 21 on the frame on the intermediate carriage 6. The ram (C) is already retracted as a result of an earlier cycle of operations. The inner forming tools 22 are extended to lie parallel to the also extended outer tools 30. Ram (B) is extended to position the pivots 23 is an appropriate position preferably opposite the pivots 31. Ram (C) is now extended until rollers 32 engage cam 33 whereupon forming commences. The carriage 6 is then further advanced by actuation of ram (B). Advancement of the carriage 7 causes the rollers 32 to move over the surface 33 in the body member 34 causing the outer forming tools 30 to move inwardly from the position shown in FIG. 1 and full lines in FIG. 2. As the outer forming tools 30 press the metal of the tube between those forming tools and the inner tools 22, to form a flange the rollers 24 engage on the cam plate 12. The back up force applied to the cam plate 12 is determined by the degree of extension of ram (A) which as stated above is controlled by the track routine and the cam plate 12 is permitted to withdraw against this pressure. The pivot points 23 on which the inner forming tools pivot are also withdrawn by the track routine operation of the servo valve 72 controlling ram (B) so that at the same time as the outer forming tools are forming the outer surface of the flange, the inner surface is also being formed by the inner forming tools being withdrawn under the control of ram (A). The result is that there is some sliding as between the inner and outer forming tools, this sliding resulting from the change in relative centers between the centers of pivoting of the outer forming tool 30 and the centers of pivoting of the inner forming tools 22, the inner forming tools 22 pivoting and also moving rearwardly relative to the carriage 6 so that the inner tools 22 slide relative to the outer tools 30, the distance of sliding being such that the pivots 23 move from the dot-dash line position of FIG. 2 to the full line position of FIG. 2 while the outer forming tools 30 pivot from the full line position shown in FIG. 2 to the dot-dash line position shown in that figure. The sliding is possible because the ribs 47 and 48 are arranged so that the respective sides 41 and 45 and the sides 42 and 46 of the forming tools are arranged parallel to each other over a substantial part of their length, and only altered from parallel as they approach the final inner radial portion of their length. The ribs 47 and 48 are triangular in height so that they disappear near the periphery of the cylinder 21 at the junction with the flange 51 being formed, this function preferably being formed as a curved area 52 as seen in FIG. 5. The result of this action is that a ribbed castellated or corrugated flange 51 (FIG. 5) is provided on one end of the drum wall 52. The pattern of rib formation comprises portions lying substantially in the same plane, which plane is substantially at right angles to the drum wall 52 with a rib 62 having a sidewall 55, a face 56 and another sidewall 57 between the portions 53 and 54 and then another oppositely directed rib 63 having a sidewall 58, a face 59 and another sidewall 60 between portions 53 and 5 before the pattern is repeated. At the inner end 61 the portions 53 and 54 disappear so that the ribs 62 and 63 simply alternate.

This arrangement is such that the length of the contour of a cross section of the flange at any radius is substantially the same as the length of a contour of a cross section at any other radius so, that substantially no compression or stretching of metal takes place.

Rotational movement of the inner tools 22 is controlled by controlling the pressure supplied to hydraulic piston and cylinder arrangement 11 by a pressure relief valve 75 as described controlled by using a microprocessor to vary the pressure in the ram, the position of rams (A), (B) and (C) otherwise controlling movement of the forming tools.

The sequence of events in the RCA 1802 microprocessor referred to above is set out in Table 1 below in Assembler language.

TABLE 1

```
**SUBROUTINE TO HANDLE SERVOTRACKING,
**PRESSURE RELIEF AND START/STOP PROFILES.
**MAIN RAM - (C), TRACKING RAM (HINGE) = (B)
**PRESSURE RELIEF RAM = (A).

**SERVOTRACKING REQUIRES (B) TO FOLLOW A
**PROFILE DEPENDENT ON THE POSITION OF (C).
**THE PROFILE BEGINS AT 1190MM.

**PRESSURE RELIEF PROFILE (A) REDUCES THE
**BACKPRESSURE AS THE FORMING OPERATION
**PROCEEDS, THE PROFILE BEGINS AT 1000MM.

**POSITION OF (C) IS READ AS TWO BYTES FROM AN
**E.D. COUNTER AT MEMORY LOCATIONS F400 (LO) &
**F401 (HI).

**POSITION OF (B) [RELATIVE TO (C)] IS READ AS
**2 BYTES PREVIOUSLY RESET AT THEIR
**RESPECTIVE DATUMS.

**TO MINIMISE TIME DELAYS IN LOOPS, SUBROUTINES &
**F ARE NOT USED. INSTEAD RELIEF, TRACKING &
**CKEMS ROUTINES ARE DUPLICATED.

**REGISTER ALLOCATION

**R0   -E.D. SERVOAMP POINTER
**R2   -STACK POINTER
**R3   -PC
**RD   -RELIEF TABLE POINTER
**RE   -START/STOP TABLE POINTER
```

TABLE 1-continued

```
**RF    -E.D. COUNTER POINTER

OR #2600

**INITIALISATION
SR2:      CALL SS
          SEX 3 , DIS , #23
          LDI #F4          ..POINT E.D. CTR & SERVO
          REGS
          PHI F            ..REGS AT E.D. PAGE, LO TYE
          IS PHI O         ..LOADED TO POINT
                           ..AT DEVICE.
          LDI #00          ..SET PTR TO RELIEF TABLE.
          PLO D
          LDI #5C
          PHI D
          LDI #00          ..SET PTR TO START/STOP
                           ..TABLE.
          PLO E
          LDI #6F
          PHI E
**ROUTINE BEGINS HERE , FIRST THE MAIN RAM IS
**STARTED
          LDI #12          ..POINT TO SERVO (C).
          PLO 0
          LDI #FF          ..TURN VALVE (C) ON.
          STR 0
**THE POSITION OF (C) IS READ & TESTED FOR THE
**START OF SERVOTRACKING, THE TEST IS A 2
**BYTE SUBTRACTION OF DEC11900 (= #2E7C) – (C) POSN.
START:    LDI #00          ..LOAD LO BYTE (C).
          PLO F
          LDA F ;STXD
          SDI #7C          ..SUB LO BYTE
          LDN F ;STR 2     ..LOAD HI BYTE (C).
          SDBI #2E         ..SUB HI BYTE
          LBNF TRACK       ..BRANCH (C) GT #2E7C.
**RELIEF ROUTINE
**EACH ENTRY (3 BYTES) IN RELIEF TABLE CONTAINS
**LO HI BREAKPOINT ADDRESSES & O/P VALUE IN
**SUCCESSIVE MEMORY LOCATIONS FROM #5C00.
**NEXT BREAKPOINT IS TESTED WITH 2 BYTE
**SUBTRACTION (C) POSN (STORED IN STACK) – BREAK-
**POINT (IN TABLE)
          IRX
          LDA D            ..TEST BREAKPOINT.
          SD               ..(C)POSN – BREAK.
          LDN D
          DEC 2
          SDB
          BDF STORE1       ..SKIP IF BREAKPOINT
                           ..REACHED.
          DEC D            ..RESTORE POINTER FOR
                           ..NEXT TEST
          LBR CKEMS1
STORE1:   LDI #11          ..STORE NEW RELIEF VALUE
          PLO 0            ..IN SERVO (A).
          INC D
          LDN D
          STR 0
          INC D            ..POINT TO NEXT BREAK-
                           ..POINT
**EMERGENCY STOP IS NOW TESTED BEFORE
**RETURNING TO S
CKEMS1:                    IRX: INP 1 : XRI #FF
          ANI #02
          LBNZ START
          DEC 2
          LBR FINISH       ..END CYCLE ON NOT S11.
**TRACKING PROFILE
**(C) POSN IS MULTIPLIED BY 2 & RESULT STORED IN RC
**AS POINTER TO "DEMAND" VALUE FOR (B).
**THE DIFFERENCE BETWEEN "DEMAND" & "ACTUAL"
**VALUES IS THE "ERROR" SIGNAL. "ERROR" IS LEVEL
**SHIFT (REQMT OF D/A) TH O/P TO SERVO (B). (C) POSN
**IS FIRST TESTED FOR CHAIF NO CHANGE HAS OCCUR-
**RED, RELIEF & STOP ROUTINES ARE BYPASSED.
TRACK:    LDI #10          ..POINTER TO SERVO (B).
          PLO 0
          LDI #00          ..LOAD LO BYTE (C).
          PLO F : IRX
          LDN F
```

TABLE 1-continued

```
          SM               ..TEST CHANGE OF (C).
          LBZ LOOP1        ..BRANCH TO LOOP W/O REL
                           ..& STOP
          LDA F            ..LOAD TO BYTE (C).
          STXD             ..STORE ON STACK.
          SHL
          PLO C            ..LO BYTE *2 NOW STORES.
          LDN F            ..NOW HI BYTE (C).
          STXD
          SHLC
          PHI C            ..RC NOW POINTS AT DEM
                           ..VAL (B).
          INC C            ..REQUIRED FOR SUB-
                           ..TRACTION.
          SEX C
          LDI #02          ..ACT LOADED INTO D &
          PLO F            ..SUBTRACTED FROM
                           ..DEM VIA RC.
          LDA F
          SD               .."ERROR" VALUE NOW IN D.
          STR 2
          LDN F            ..NOW HIGH BYTE.
          DEC C
          SDB
          BZ INRGEI        ..IF D = 0, "ERROR" IN
                           ..RANGE.
          BNF LOW1         ..IF DF = 0, "ERROR" HIGH.
          LDI #FF
          STR 0
          BR CONT1
LOW1:     LDI #00          ..IF DF = 1, "ERROR" LOW
          STR 0
          BR CONT1
INRGE1:   LDA 2
          ADI #80
          STR 0
CONT1:    SEX 2
          IRX              ..RESTORE STACK PTR.
**RELIEF PROFILE (A DUPLICATION)
          LDA D
          SD
          LDN D
          DEC 2
          SDB
          BDF STORE2
          DEC D:IRX
          LBR CKST
STORE2:   IRX
          LDI #11
          PLO 0
          INC D
          LDN D
          STR 0
          INC D
**STOP ROUTINE (NOT USED IN VERSION 1 FOR COM-
**MISSION BECAUSE OF LOW SPEED OF MAIN RAM).
CKST:     LDI #B0          ..STOP VALVE LO (STOP
                           ..VALUE = #36BO).
          SM               ..TEST (C) GT STOP VALUE.
          LDI #36          ..STOP VALUE HI.
          DEC 2
          SMB
          BDF CKEMS2       ..SKIP LT.
          LBR FINISH       ..END OF CYCLE.
CKEMS2:                    INP 1 : XRI #FF
          ANI #02
          LBNZ TRACK
          LBR FINISH       ..END CYCLE ON NOT S11.
LOOP1:    LDA F            ..DUPLICATE OF TRACKING
          STXD             ..ROUTINE WHICH BY-
          SHL              ..PASSES RELIEF & STOP
          PLO C            ..ROUTINES.
          PLO C
          LDN F
          STXD
          SHLC
          PH1 C
          INC C
          SEX C
          LDI #02
          PLO F
          LDA F
```

TABLE 1-continued

```
          SD
          STR 2
          LDN F
          DEC C
          SDB
          BZ INRGE2
          BNF LOW2
          LDI #FF
          STR 0
          BR CONT2
LOW2:     LDI #00
          STR 0
          BR CONT2
INRGE2:   LDA 2
          ADI #80
          STR 0
CONT2:    SEX 2
CKEMS3:                    INP 1 : XRI #FF
          ANI #02
          LBNZ TRACK
          LBR FINISH       ..END CYCLE ON NOT S11
FINISH:   IRX
          SEX 3 : RET , #23
          CALL RS
          LBR GETOPR
          NOP
```

What is claimed is:

1. A method of flanging one end of a thin metal tube comprising the steps of mounting a sheet metal tube on a carriage, clamping the tube to the carriage, placing complementary pivotal inner and outer forming tools with parts thereof in contact with the inner and outer surfaces respectively of one end portion of said tube, the inner forming tools being pivotal on an inner frame and the outer forming tools being pivotal on an outer carriage, and forming a radially inwardly directed flange on said one end portion by pivotally moving the inner and outer forming tools with said tube end portion between them to displace said one end portion radially inwardly and form ribs thereon, and moving the pivot axes of said forming tools relatively to each other in a direction parallel to the tube axis and slidingly with respect to said one end portion during the formation of said flange and ribs to produce said flange having a cross-sectional shape which includes two sets of oppositely directed ribs the sides of which increase in depth from the tube wall towards the tube center.

2. A method as claimed in claim 1 wherein said outer forming tools are pivotally moved by moving them axially in a direction parallel to said tube axis to cause a roller on an outer part of each outer forming tool to engage a fixed cam surface.

3. A method as claimed in claim 1 or claim 2 wherein said pivotally moving said inner forming tools comprises moving a hydraulically actuated cam plate in a direction parallel to said tube axis to engage a roller on a part of each inner forming tool, the plate being moved at a rate appropriately related to the movement of the outer forming means to cooperatively produce said ribbed flange.

4. A method as claimed in claim 3 and further comprising controlling withdrawal of said cam plate relative to said carriage during the flanging operation so that said inner forming tools move through substantially 90°.

5. A method as claimed in claim 4 wherein the step of controlling withdrawal of said cam plate comprises controlling the pressure in a piston and cylinder assembly which holds said inner forming tools against the flange being formed.

6. A method as claimed in claim 2 and further comprising moving said outer forming tools through substantially 90° by moving an outer carriage on which said outer forming tools are pivotally mounted relative to said cam surface and causing rollers on said outer forming tools to engage and roll on said cam surface thereby transmitting force to said flange being formed.

7. Apparatus for flanging and ribbing one end of a thin metal tube comprising a frame, a plurality of rod members extending between the ends of said frame and along an axis of said frame, an outer carriage slidable on said rod members, a plurality of radially extending circumferentially spaced outer forming tools pivotally mounted on said outer carriage so as to be substantially radially pivotal through substantially 90°, an intermediate carriage slidable on said rod members, clamping means on said intermediate carriage to clamp a tube to be flanged thereon with the tube axis oriented parallel to said axis of said frame, a plurality of radially extending circumferentially spaced inner forming tools pivotally mounted on said intermediate carriage for substantially radially pivotal movement through substantially 90°, means to cause said outer forming tools to pivot through said substantially 90°, and force supplying means operatively connected to said inner and outer forming tools to move said inner and outer forming tools with respect to said frame and each other in a manner such that a radially inwardly directed flange on one end of said tube disposed between said forming tools is formed, said flange having a width less than the radius of the tube and a cross-sectional shape in the form of a series of two sets of oppositely directed ribs the sides of which increase in depth from the tube wall towards the tube center, said force supplying means including means to displace the pivotal axes of said tools with respect to each other in a direction parallel to the frame axis during formation of the flange.

8. Apparatus as claimed in claim 7 wherein said means to cause said outer forming tools to pivot comprises a cam member on said frame, a concave cam surface on said cam member, and cam followers mounted on said outer forming tools, said cam surface and cam followers being relatively positioned so that they cooperatively engage when said outer forming tool is moved by said force supplying means in said manner to form said flange.

9. Apparatus as claimed in claim 7 or claim 8 wherein said force supplying means comprises a cam plate actuating ram mounted on said intermediate carriage and a cam plate mounted on said actuating ram, and further comprising a cam plate follower means on said inner forming tools engageable by said cam plate when said force supplying means is moved in said manner to form said flange to pivotally move said inner forming tools through said substantially 90°.

10. Apparatus as claimed in claim 9 wherein said force supplying means further comprises a master piston and cylinder assembly mounted on said frame and a master carriage slidably mounted on said rod members operably connected to said master piston and cylinder assembly to be moved thereby, an intermediate piston and cylinder assembly mounted on said master carriage operably engaging said intermediate carriage to control the movement thereof, and means to operably connect said master carriage to said outer carriage so that said outer carriage is actuated by said master carriage to control the movement of said outer forming tools.

11. Apparatus as claimed in claim 10 wherein said cam plate actuating ram comprises a piston and cylinder means, and the movement of said inner forming tools is controlled by the pressures within said cam actuating ram and said intermediate piston and cylinder assembly.

* * * * *